United States Patent [19]

Prunbauer

[11] 4,084,416

[45] Apr. 18, 1978

[54] MAGNETIC-TYPE LOCK

[75] Inventor: Kurt Prunbauer, Herzogenburg, Austria

[73] Assignee: EVVA Werk Spezialerzeugung von Zylinder- und Sicherheitsschlossern Gesellschaft m.b.H. & Co. Kommanditgesellschaft, Vienna, Austria

[21] Appl. No.: 700,207

[22] Filed: Jun. 28, 1976

[30] Foreign Application Priority Data

Jul. 3, 1975 Austria ..... 5119/75

[51] Int. Cl.[2] ..... E05B 47/00

[52] U.S. Cl. ..... 70/276; 70/356; 70/365; 70/413

[58] Field of Search ..... 70/276, 413, 356, 365, 70/366

[56] References Cited

U.S. PATENT DOCUMENTS

| | | | |
|---|---|---|---|
| 3,570,287 | 3/1971 | Hallmann | 70/365 X |
| 3,654,782 | 4/1972 | Heimann | 70/276 |
| 3,797,288 | 3/1974 | Hallmann | 70/276 |
| 3,837,194 | 9/1974 | Fish | 70/276 |
| 3,855,827 | 12/1974 | Hallmann et al. | 70/276 X |
| 3,935,720 | 2/1976 | Böving | 70/276 |

*Primary Examiner*—Roy D. Frazier
*Assistant Examiner*—William E. Lyddane
*Attorney, Agent, or Firm*—Michael J. Striker

[57] ABSTRACT

A lock has a cylinder formed with a keyhole and rotatable in a housing. At least one tumbler is displaceable into the keyhole into engagement with a bit of a key which can position the segments of the tumbler so as to allow rotation of the cylinder in the housing. In addition the key is provided with a magnet that can coact with a magnetic rotor to rotate this magnet into a position that aligns a notch on the magnet or a control wheel controlled thereby with a retaining element. The housing is formed at its back end with a recess in which one end of the retaining element is urged by a weak spring. Only when the notches on the rotors are aligned with tabs on the retaining element can this element be displaced out of the recess in the housing and allow rotation of the cylinder relative to the housing.

10 Claims, 10 Drawing Figures

4
2
5
7
8
6
5

MAGNETIC-TYPE LOCK

BACKGROUND OF THE INVENTION

The present invention relates to a control device. More particularly this invention concerns a magnetic-type lock.

A magnetic-type lock is known wherein the key carries one or more magnets which coact with magnetic tumblers or the like in the cylinder of the lock in order to allow this cylinder to rotate relative to its housing. Such locks have several disadvantages. First of all it is relatively common for the magnetic tumblers, which must be relatively loose in order to be magnetically displaceable, to become jammed in the lock. Furthermore in such systems it is almost always possible to pull out the key when the cylinder is twisted relative to the housing so that a frequent occurrence is that the lock is accidentally left unlocked.

Another disadvantage of the known magnetic-type locks is that the variations in coding are relatively limited. Thus the pick resistance which such locks are known for is in part counterbalanced by the fact that only a relatively small number of different lock combinations are possible.

SUMMARY OF THE INVENTION

It is therefore an object of the present invention to provide an improved control device.

Another object is the provision of an improved magnetic-type lock which overcomes the above-given disadvantages.

These objects are attained according to the present invention in a lock comprising a generally non-rotatable housing, a cylinder rotatable in this housing and formed with a keyhole, at least one tumbler displaceable into the keyhole and slidable in the housing and cylinder between a locked position inhibiting relative rotation of the cylinder and housing and an unlocked position permitting such rotation, at least one magnetic rotor rotatable in the housing between a ready position and an unready position, and a retaining element engageable with the housing and with the rotor and displaceable in the cylinder only when the rotor is in its ready position from an engaged position inhibiting rotation and a disengaged position permitting such rotation. This lock is operated by and includes a key which is insertable into the keyhole and carries a magnet juxtaposable with the rotor to rotate this rotor into the ready position. Furthermore this key is formed with at least one tumbler-displacing formation or bit engageable with the tumbler to displace the tumbler into the unlocked position. Thus with the lock according to the present invention the cylinder or plug can only be rotated in its housing when a key that is both properly magnetically coded and which has the proper bit is inserted in the keyhole.

Such an arrangement allows an enormous number of different combinations to be coded into the lock. Thus not only is the lock highly pick resistant, but even assuming a purely random attempt is made to open the lock with various types of keys the chance of hitting the right combination is minute. Furthermore the pin tumblers of the lock in accordance with this invention hold the cylinder inside the housing against rotation until the key is completely inserted. Thus the magnetic rotors will have time to be magnetically diplaced into their ready positions before the cylinder can be rotated so that jamming of these rotors in the lock is impossible.

Furthermore the key cannot be withdrawn from the lock unless the cylinder is in the position with the segments of the pin tumblers lined up so that the key cannot inadvertently be withdrawn and the lock left open unless a special open position is provided.

In accordance with this invention a plurality of such tumblers and a plurality of such rotors are provided. Several such magnets are provided on each side of the key each coacting with a respective rotor. The provision of a plurality of such axially spaced magnets has the considerable advantage that the end magnet, which in its own right acts on the end rotor, serves to rotate the other rotors as the key is withdrawn thereby automatically scambling the combination. The provision of a plurality of such tumblers also makes the lock extremely strong and not subject to forcing, as more than the simple retaining element serve to hold the cylinder against rotation in the housing, the various tumblers also preventing such rotation so that forcing of the lock is almost impossible.

According to further features of this invention each of the rotors is formed with a radially open notch or cutout. The retaining element has tabs or the like engageable in these cutouts only in the ready position of the rotors. Furthermore the rotors are rotatable about respective rotor axes which cross and may intersect the rotation axis of the cylinder in the housing. Thus the magnets on the key are polarized in a plane that lies on or parallel to the cylinder axis when the key is inserted in the plug.

According to yet another feature of this invention each of the rotors includes a magnetic disc polarized in a direction diametrical of the respective rotation axis. Furthermore each such rotor may be mounted on an axle having pointed ends which are seated in the cylinder and provide an almost friction-free support for the rotor. Each such magnetic disc may be associated with a control wheel that coacts with the respective retaining element tab.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
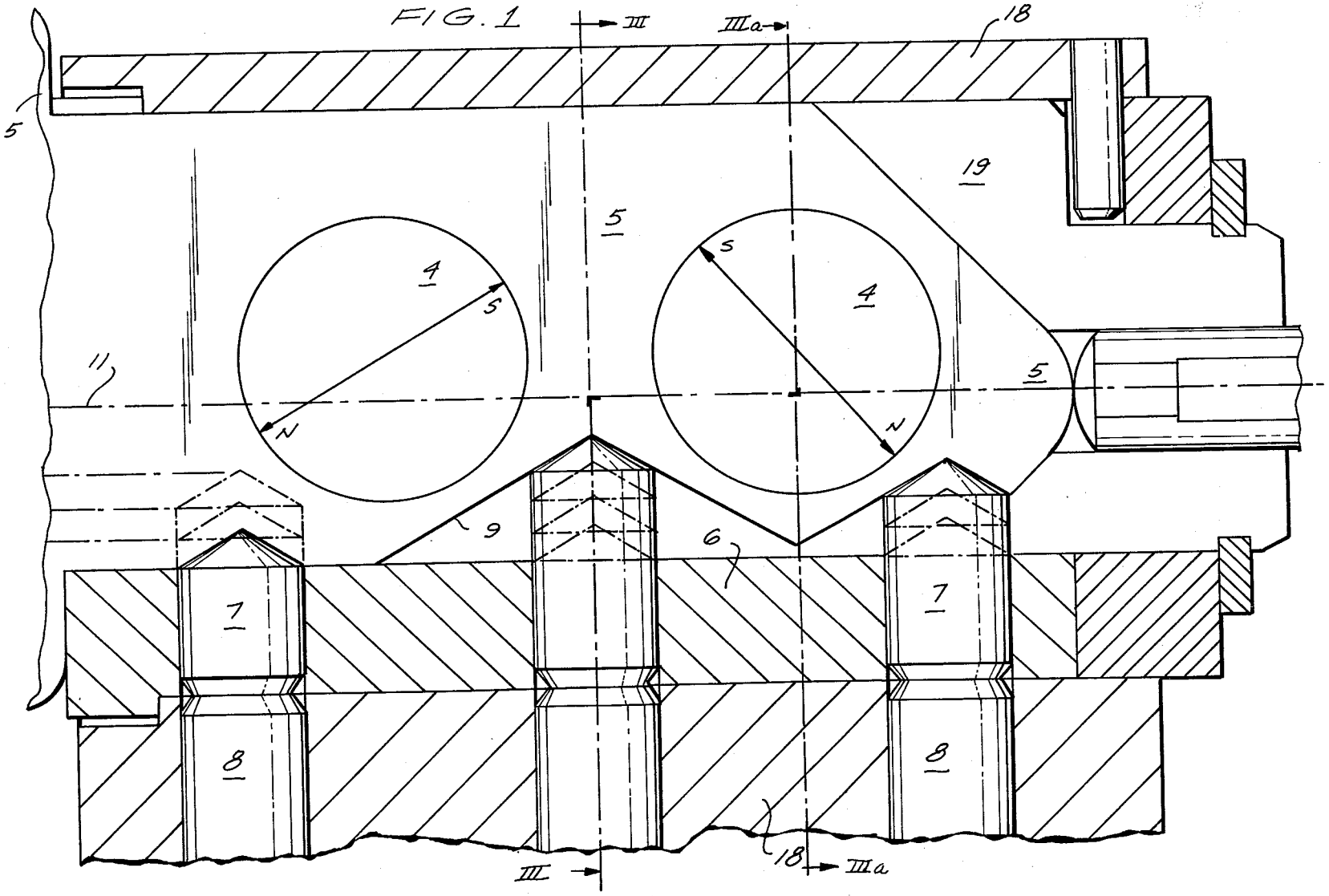
FIG. 1 is an axial section through a lock according to this invention.
Figure 2:
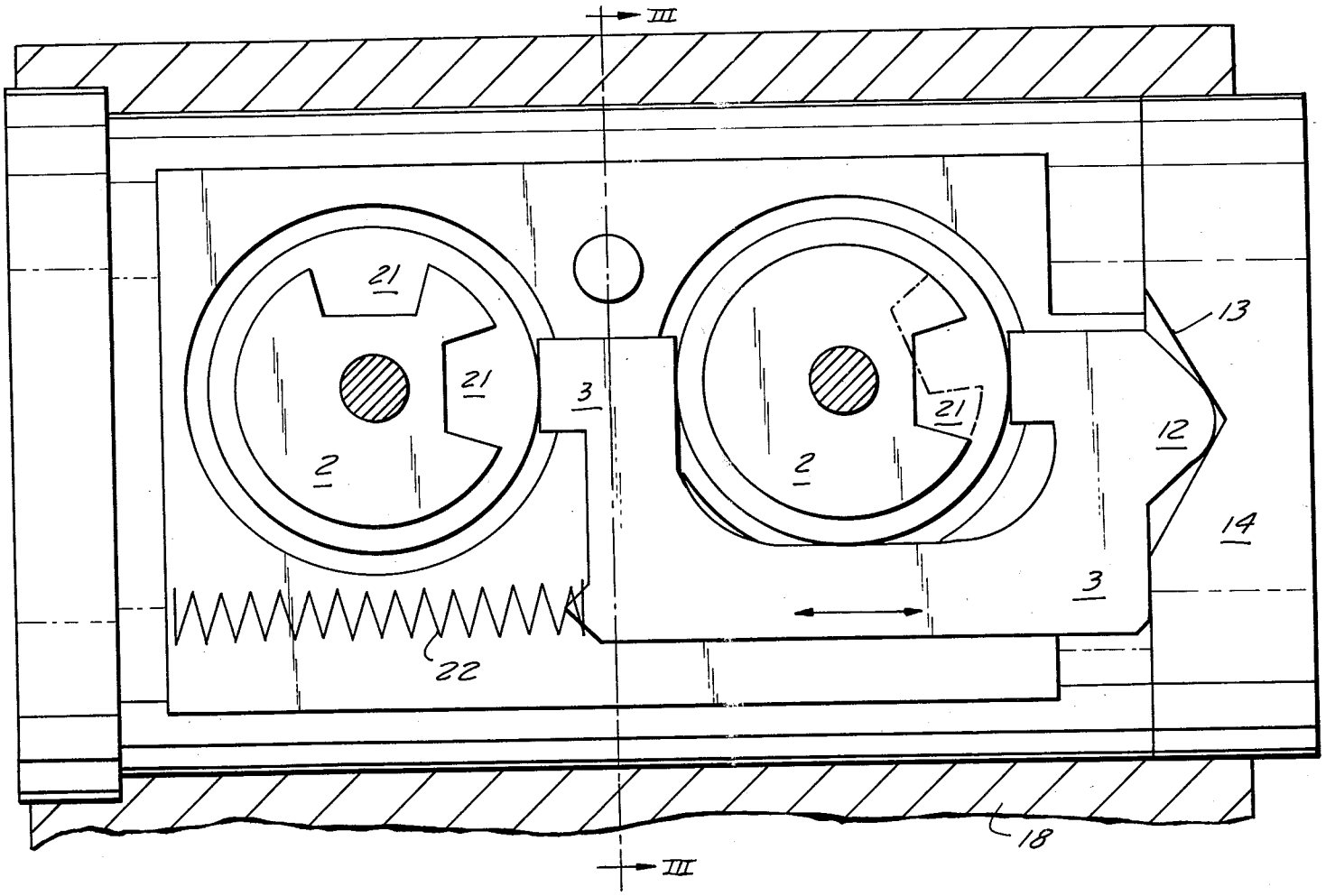
FIG. 2 is another axial section through the lock according to this invention.
Figure 3:
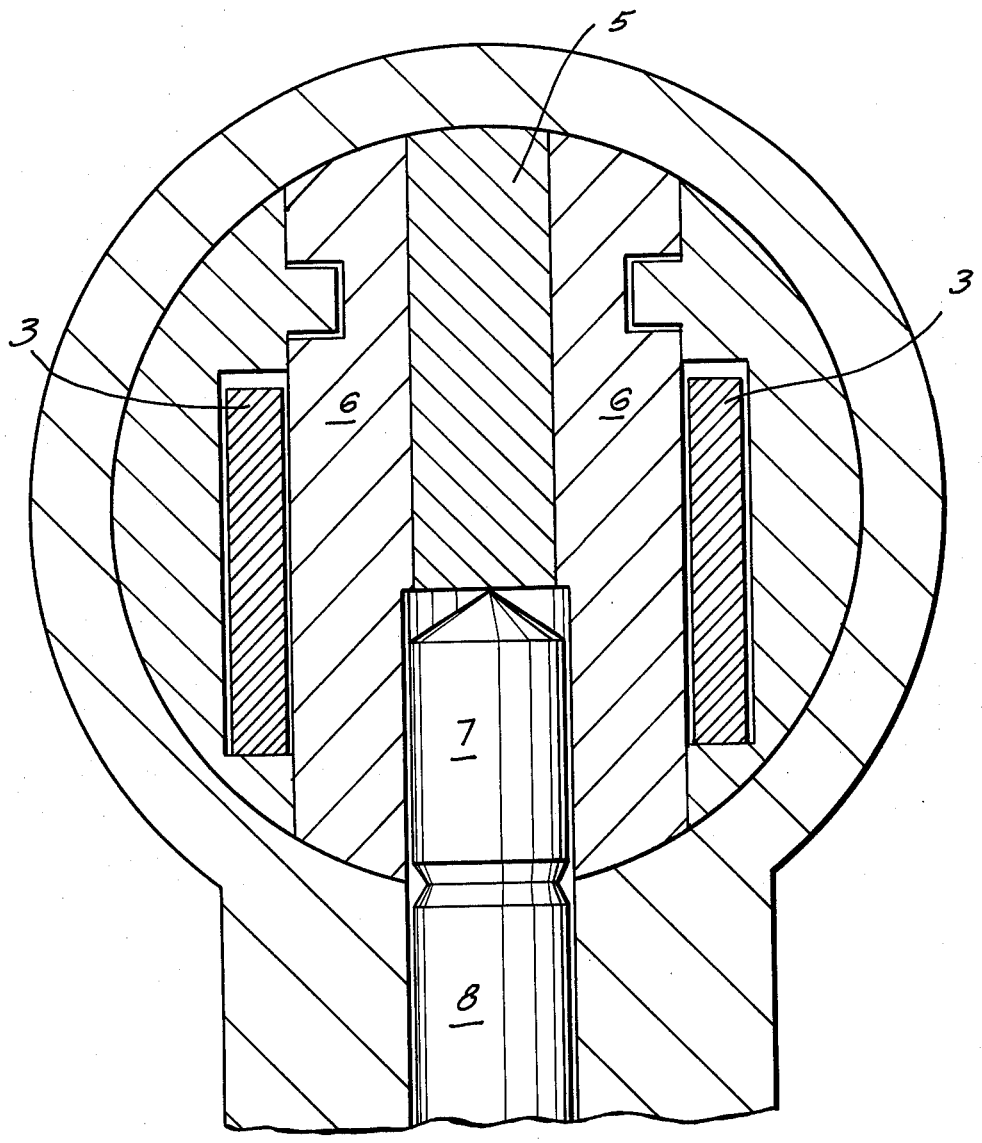
FIG. 3 is a section taken along line III—III of FIGS. 1 and 2.
Figure 3A:
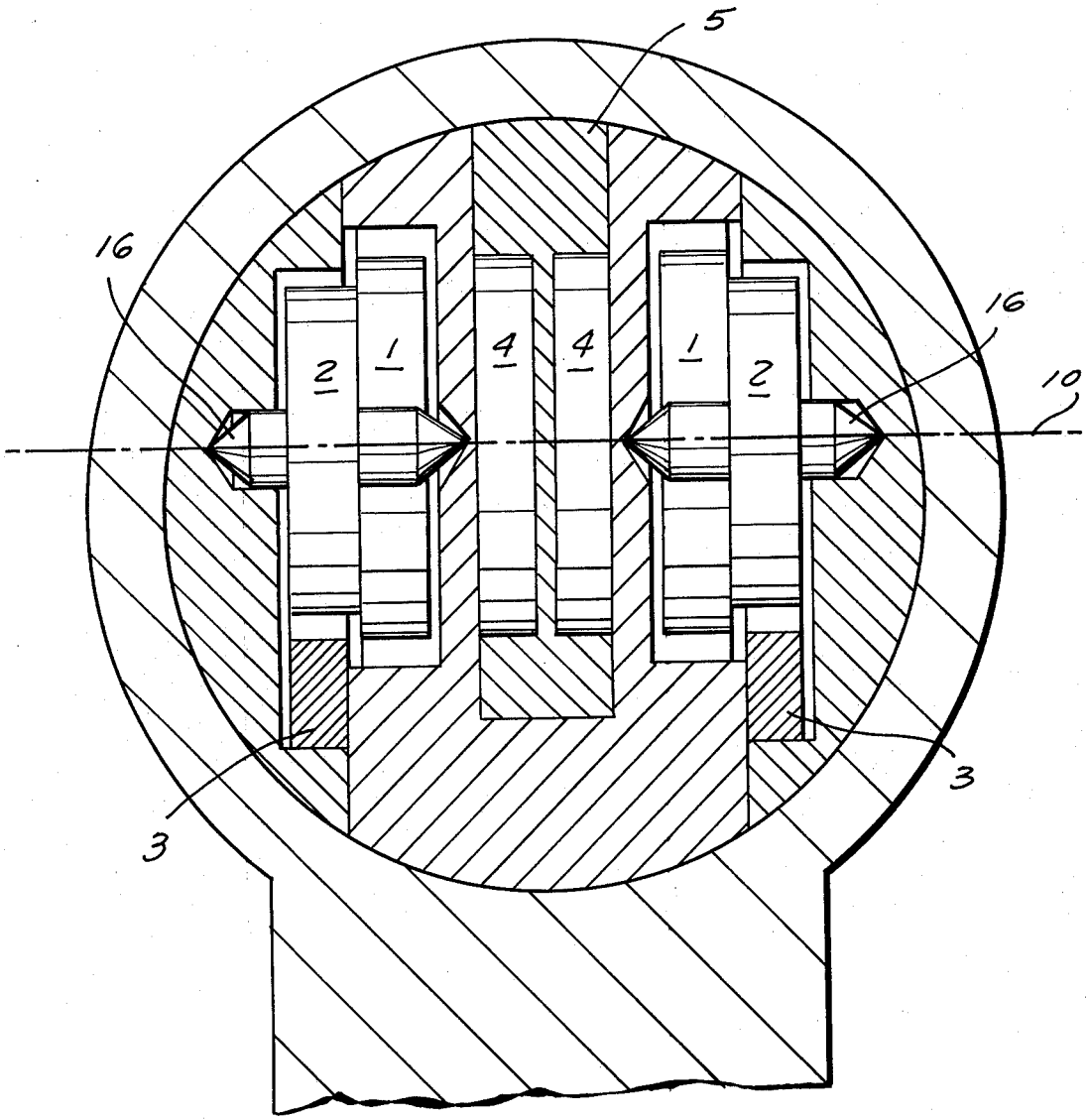
FIG. 3*a* is a section taken along line III*a*—III*a* of FIG. 1.
Figure 4:
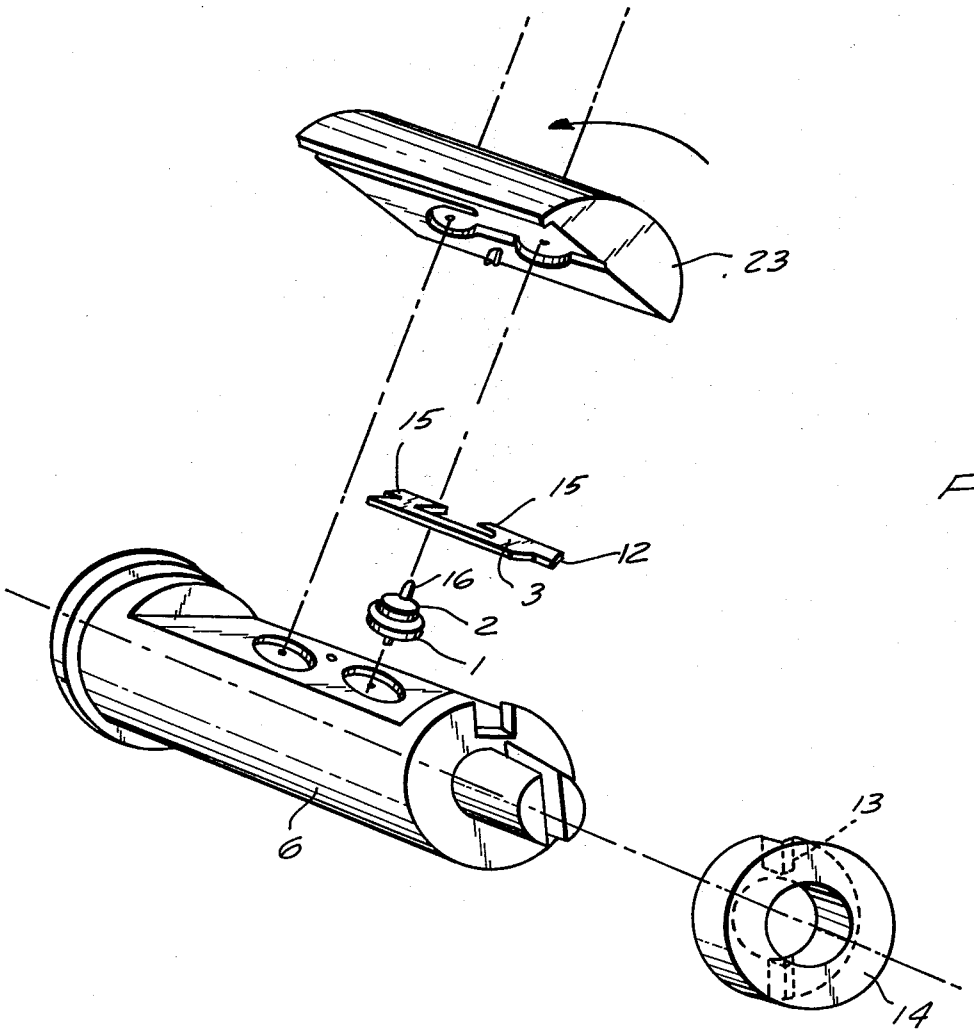
FIG. 4 is a perspective exploded view of the lock of FIGS. 1–3.

The lock shown in FIGS. 1–4 has a housing 18 in which a cylinder 6 is rotatable about a cylinder axis 11. This cylinder 6 is formed at the axis 11 with a keyhole 19 in which a key 5 is engageable.

At one side of the housing 18 and the cyliner 6 there is provided a series of tumblers 7, 8 which are of standard two-part pin tumbler configuration and which are engageable with standard bit formations 9 of the key 5. In this respect the lock acts as a standard pin-type cylinder lock, with the bits 9 depressing the cylinder segments 7 so that the split between the segments 7 and 8 lies flush with the cylinder 6, thereby permitting rotation of the cylinder 6 by the key 5 inserted in the keyhole 19.

Figure 5:
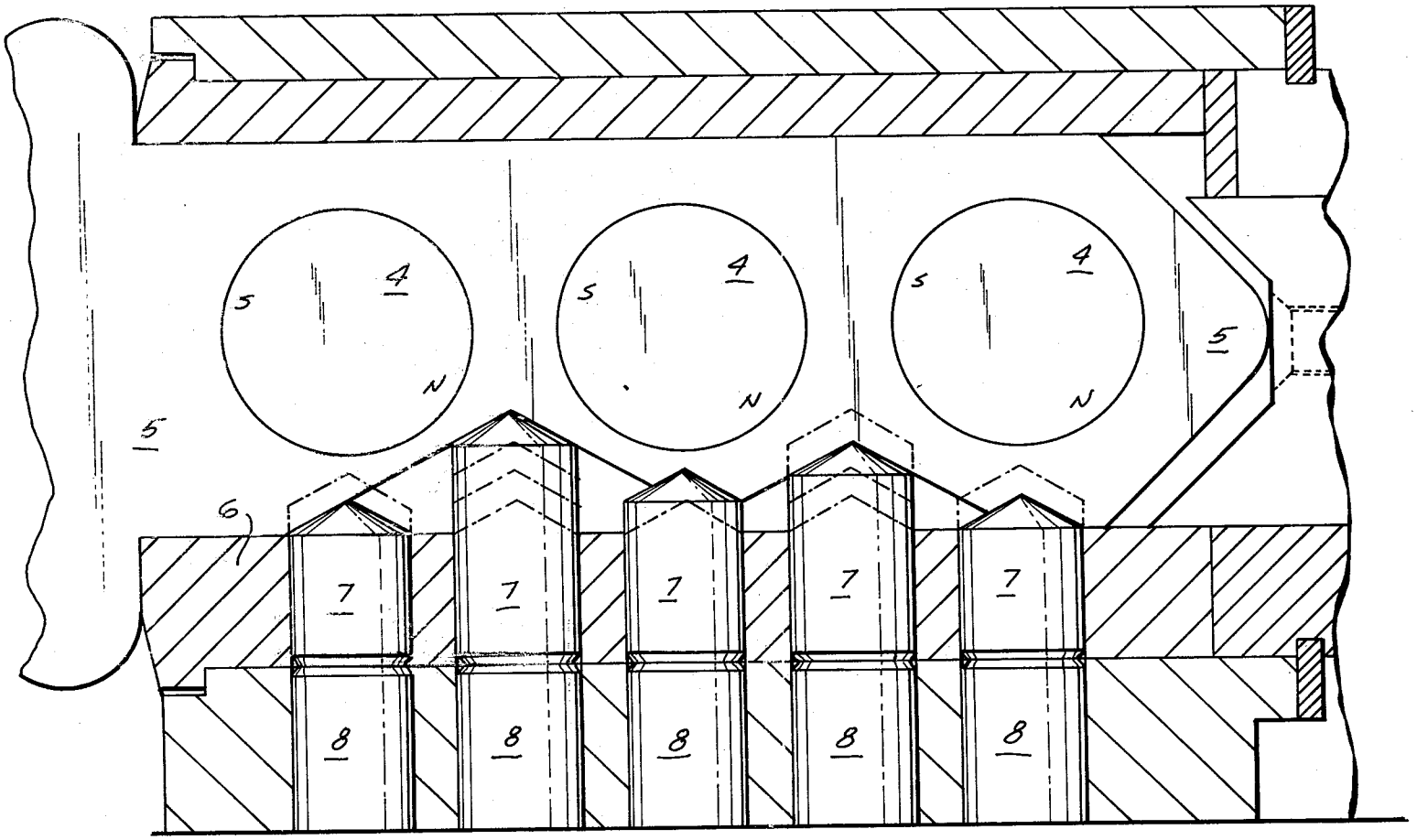
FIGS. 5 and 6 are axial sections through another lock in accordance with this invention.
Figure 6:
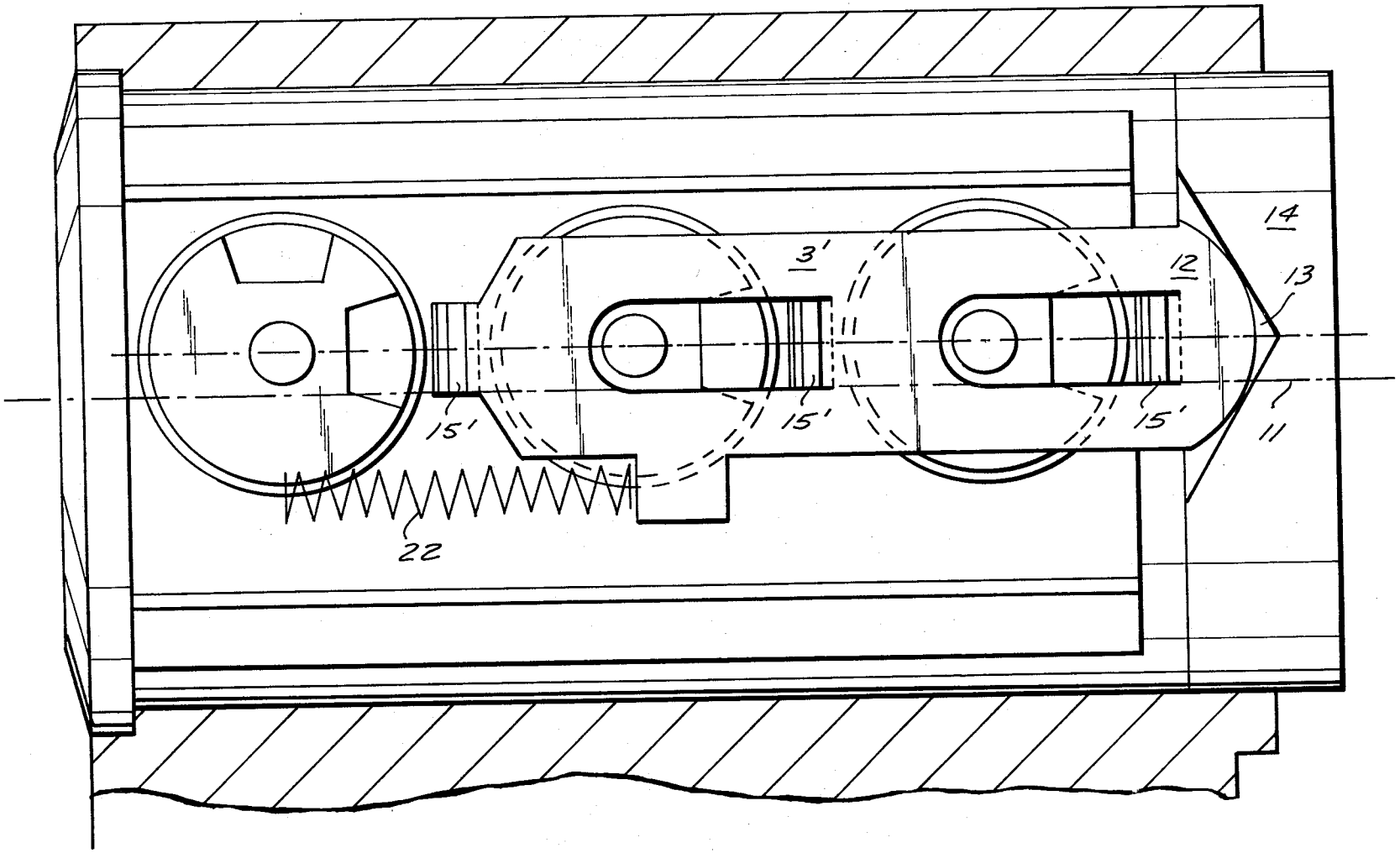
Figure 7:
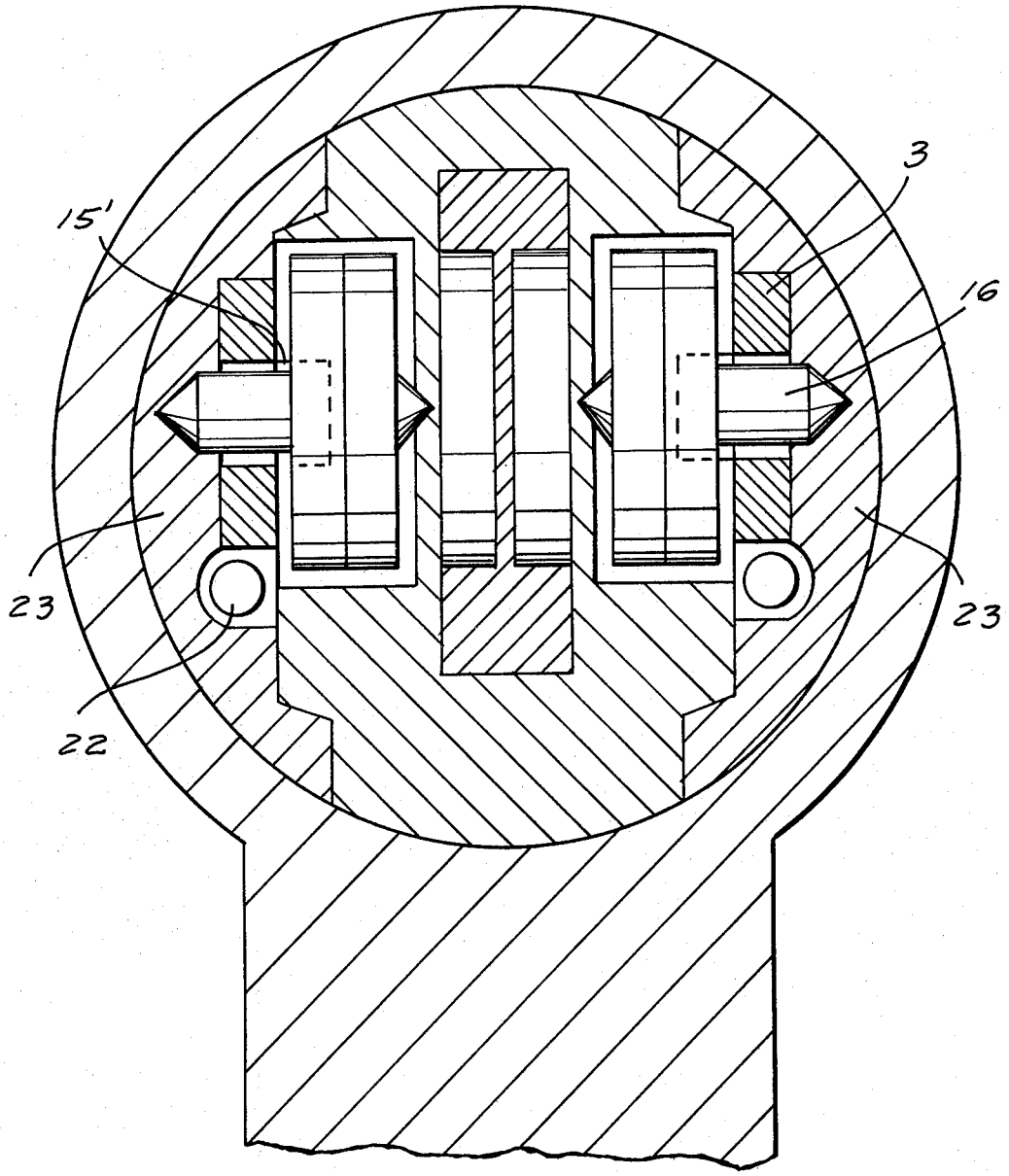
FIG. 7 is a cross-section through the lock of FIGS. 5 and 6.

In addition the key is provided on both sides with pairs of disc magnets 4 polarized in the plane of the key as seen in FIG. 5. The lock is provided with magnetic rotors 1, 2 comprising a magnetically polarized disc 1 and a control wheel 2. These two elements are both rotatably carried on an axle 16 having pointed ends seated in the cylinder 6 and a lateral cover plate 23 constituting part of the cylinder for rotation of the two elements 1 and 2 about an axis 10 that crosses the axis 11 but is spaced therefrom in the keyhole 19. When the key 5 is fully inserted in the keyhole 19 each of the magnets 4 lies directly axially in line with a respective one of the magnetic discs 1 which are also polarized perpendicular to their rotation axes 10 and, therefore, parallel to the polarization of the magnet 4.

The control discs 2 are formed with radial cutouts 21 in which are engageable tabs 15 on a retaining element 3 having an end 12 urgable axially by a relatively weak spring 23 into a recess 13 formed at the rear wall 14 of the housing 18. When the retaining element 3 is in the position shown in FIG. 2 it prevents rotation of the plug or cylinder 6 about the axis 11 so as completely to block operation of the lock. Only when the two control wheels 2 are in solid-line positions of FIG. 2 does rotation of the cylinder 6 allow the recess 13 to cam the nose 12 axially backwardly and force the tabs 15 into into the recesses 21, thereby permitting operation of the lock. It is noted in this respect that one of the control wheels 2 has two such cutouts 21 to allow master-keying of the lock.

With the lock shown in FIGS. 1–4 it is possible to code the magnets 4 alone so that 20,000 possibilities exist, allowing an angular offset of 30° between different positions of the magnets 4 and discs 1. Assuming that at least thirty-six different combinations can be obtained with the pin tumblers 7, 8 it is therefore possible to obtain more than approximately 700,000 different codings in the relatively simple lock shown.

The lock of FIGS. 5–9 is substantially similar in function to the lock of FIGS. 1–4, except that here five pin tumblers 7, 8 are employed along with three magnets 4 on each side of the key 5. This arrangement therefore allows, assuming that five different positions are possible for the pin tumblers 7 and that the magnets 4 are each setable in eight different angularly offset positions (45°) more than 33.5 million possibilities. This is calculated as $8^6$ possibilities for the magnets, thus 262,144 possible combinations with the magnets alone, and five different pins giving 128 different possibilities.

Whereas in FIGS. 1–4 the retaining element 3 lies in substantially the same plane as the control wheels 2, in the arrangement of FIGS. 5–9 the retaining element 3' lies in a plane next to these control wheels 2 and has laterally offset tabs 15' that engage in the recesses 21. In all other respects the two devices are identical.

Figure 8:
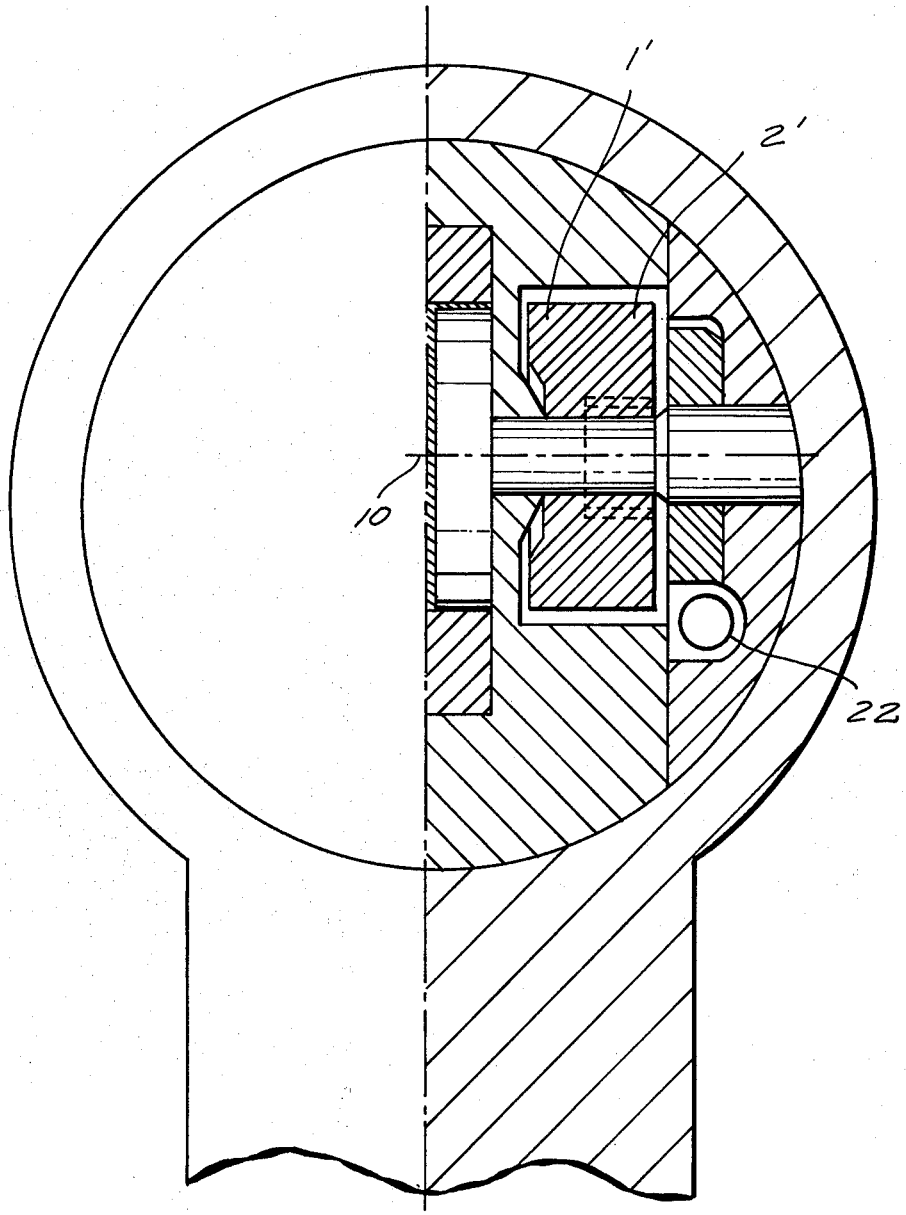
FIG. 8 is a view similar to FIG. 7 illustrating another lock in accordance with this invention.
Figure 9:
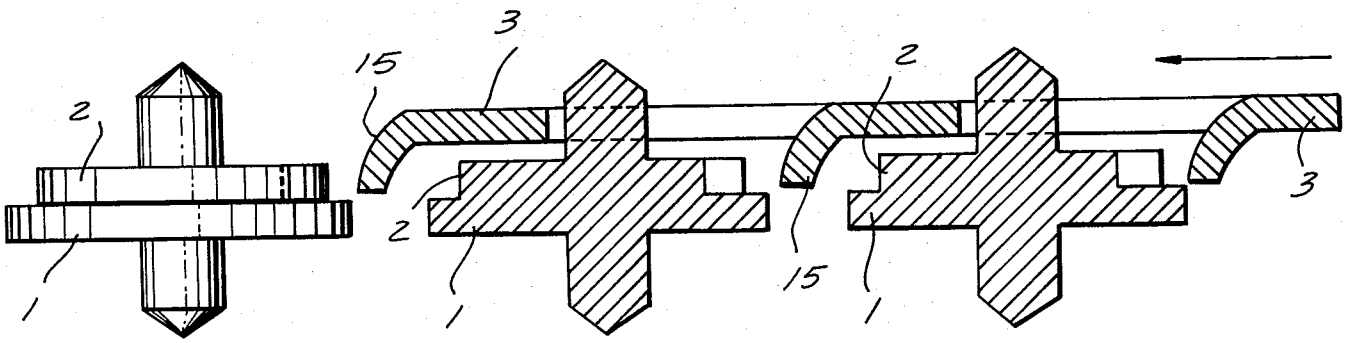
FIG. 9 is an axial section through a detail of the lock of FIGS. 5–7.

FIG. 8 shows another variation on the system wherein the pointed-end axle is replaced by a fixed pivot 17 on which an integral and unitary disc 1' and control wheel 2' are carried.

With the lock according to the present invention it is therefore possible to obtain an immense number of different combinations. Furthermore the lock will have the outer appearance of a standard lock and even the key will have the outer appearance of a standard key. Decoding of the key and reproduction will be a task that can only be carried out with considerable equipment so that unauthorized opening of the lock is almost impossible unless a key is supplied by the owner.

It is noted that the drawings shown here provides for bitting of the key on only one side. In fact there is provided a double-bitted key in order further to increase the combination possibilities and to even provide more magnets and respective rotors. The lock can be provided for a standard door in which case a cylinder can be provided on one or both sides, or can be used in a steering wheel, a strongbox, or virtually any application where a virtually pick-proof lock is needed. The entire lock can be made of bronze or steel, although it is necessary to employ non-ferrous material for the cylinder 6 which comes between the elements 1 and 4.

It will be understood that each of the elements described above, or two or more together, may also find a useful application in other types of structures differing from the types described above.

While the invention has been illustrated and described as embodied in a lock, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic aspects of this invention.

What is claimed as new and desired to be protected by Letters Patent is set forth in the appended claims:

1. A lock comprising:

a generally nonrotatable housing;

a cylinder rotatable in said housing and formed with a keyhole defining an axis;

at least one tumbler radially displaceable into said keyhole and having a housing part and a cyliner part radially slidable in said housing and cylinder between a locked position with one of said parts extending between said housing and said cylinder and inhibiting relative rotation of said cylinder and housing and an unlocked position with said housing part in said housing and said cylinder part in said cylinder and permitting said rotation;

at least one magnetic rotor element rotatable in said cylinder between a ready position and an unready position;

a retaining element engageable with said housing and with said rotor element and displaceable generally axially in said cylinder only when said rotor element is in said ready position from an engaged position inhibiting said rotation into a disengaged position permitting said rotation, one of said elements being formed with an open notch and the other of said elements having a part axially engageable therein only in said ready position; and a key insertable axially into said keyhole and carrying a magnet juxtaposable with said rotor element to rotate same into said ready position and formed with at least one bit radially engageable with said tumbler to displace same radially into said unlocked position.

2. The lock defined in claim 1, wherein said key carries a plurality of such magnets and is formed with a plurality of such bits, said lock further comprising respective rotor elements and tumblers for each of said magnets and bits.

3. The lock defined in claim 2, wherein said cylinder is rotatable in said housing about a cylinder axis and said rotor elements are rotatable about respective rotor axes that cross said cylinder axis.

4. The lock defined in claim 3, wherein said retaining element is slidable in said cylinder generally parallel to said cylinder axis and said housing is formed with a recess in which an axial end of said retaining element is receivable in said engaged position thereof.

5. The lock defined in claim 4, wherein two such rotor elements are provided flanking said keyhole and said retaining element and rotor elements lie in planes extending generally parallel to said cylinder axis.

6. The lock defined in claim 4, wherein at least three such rotor elements are provided flanking said keyhole and said retaining element is displaceable in a plane next to said rotor elements and generally parallel to said cylinder axis, said retaining element having laterally projecting tabs engageable with said rotor elements and constituting the parts engageable in the notches in said rotor elements.

7. A lock comprising:

a generally nonrotatable housing;

a cylinder rotatable in said housing about a cylinder axis and formed with a keyhole extending along said axis and with a plurality of axially spaced and radially extending inner tumbler passages opening into said keyhole, said housing being formed with a plurality of outer tumbler passages radially alignable with said inner passages in a predetermined angular position of said cylinder in said housing;

respective inner tumbler parts displaceable radially in said inner tumbler passages and in said predetermined angular position in the respective outer tumbler passages also, whereby when any of said inner tumbler parts is positioned bridging the respective inner and outer tumbler passages rotation of said cylinder in said housing is impeded;

respective outer tumbler parts displaceable radially in said outer tumbler passages and in said predetermined angular position in the respective inner tumbler passages also, whereby when any of said outer tumbler parts is positioned bridging the respective inner and outer tumbler passages rotation of said cylinder in said housing is impeded;

a key axially fittable into said keyhole and having a plurality of bits each engageable with a respective inner part and dimensioned radially so that when said key is fully inserted into said keyhole said inner parts lie only in said inner passages and said outer parts lie only in said outer passages and rotation of said cylinder in said housing is not impeded by said tumbler parts;

a plurality of magnetic rotors in said cylinder each rotatable therein about a respective rotor axis transverse to said cylinder axis and each formed with a notch opening radially relative to the respective rotor axis, each of said rotors being angularly displaceable into and out of a ready position with the respective notch opening parallel to said cylinder axis and in the same direction as the other notches;

a plurality of magnets on said key each alignable along a respective rotor axis with a respective rotor and each polarized transversely to said cylinder axis so that when said key is fully inserted in said keyhole said rotors move angularly into said ready positions;

a retaining element slidable in said cylinder adjacent said rotors generally parallel to said cylinder axis and having tabs each engageable in the notch of a respective rotor only in the ready position thereof and having an axial end, said housing being formed offset from said cylinder axis with a recess opening axially thereof toward said retaining element, said retaining element being displaceable along said cylinder axis in said predetermined angular position of said cylinder and in said ready positions of said rotors between a blocking position with said tabs spaced from the respective rotors and said axial end engaging in said recess and impeding rotation of said cylinder in said housing and an unblocking position with said tabs in the respective notches and said axial end out of said recess, said retaining element only being displaceable into said unblocking position when said rotors are in said ready positions; and a spring axially biased said axial end of said retaining element into said recess and thereby urging said element into said blocking position.

8. The lock defined in claim 7, wherein at least one of said rotors is formed with at least two such cutouts.

9. The lock defined in claim 7, wherein each rotor includes a magnetically coded disc, a control wheel engageable with said retaining element, and an axle carrying said disc and wheel and having pointed ends seated in said cylinder.

10. The lock defined in claim 7, wherein each rotor includes a magnetically coded disc and integral therewith a control wheel engageable with said retaining element, said lock further comprising axles fixed in said cylinder and rotatably supporting said rotors.

* * * * *